US006988842B2

(12) United States Patent
Miller et al.

(10) Patent No.: US 6,988,842 B2
(45) Date of Patent: Jan. 24, 2006

(54) METHOD AND APPARATUS FOR CONTINUOUS HIGH SPEED DIGITAL METERING USING MULTIPLE PRINT HEADS

(75) Inventors: John P. Miller, Shelton, CT (US); John W. Sussmeier, Cold Spring, NY (US); Anthony E. Yap, Danbury, CT (US)

(73) Assignee: Pitney Bowes Inc., Stamford, CT (US)

( * ) Notice: Subject to any disclaimer, the term of this patent is extended or adjusted under 35 U.S.C. 154(b) by 0 days.

(21) Appl. No.: 10/675,362

(22) Filed: Sep. 30, 2003

(65) Prior Publication Data

US 2005/0069365 A1 Mar. 31, 2005

(51) Int. Cl.
*B41J 11/50* (2006.01)

(52) U.S. Cl. ..... 400/605; 400/582; 400/124.08

(58) Field of Classification Search ..... 400/605–609, 400/582, 124, 124.08; 101/91; 271/270, 271/111; 347/104, 215
See application file for complete search history.

(56) References Cited

U.S. PATENT DOCUMENTS 5,683,190 A * 11/1997 Gawler ..... 400/582
5,829,895 A * 11/1998 Hayashi et al. ..... 400/124.05
6,361,163 B1 * 3/2002 Fowlkes ..... 347/104
6,607,317 B2 * 8/2003 Morozumi et al. ..... 400/82

FOREIGN PATENT DOCUMENTS

JP 410006583 * 1/1998

* cited by examiner

*Primary Examiner*—Andrew H. Hirshfeld
*Assistant Examiner*—Marissa Ferguson
(74) *Attorney, Agent, or Firm*—Michael J. Cummings; Charles R. Malandra, Jr.; Angelo N. Chaclas

(57) ABSTRACT

A printing apparatus and method to for use in a continuous high velocity mail production system, preferably for printing postal indicia. A transport path conveys a series of mail pieces at a print velocity. At least two ink jet print heads are available to perform printing operations. During normal operation, only one print head is operating at a time. To allow continuous uninterrupted operation, when a first print head is removed from service for a maintenance operation, a second print head is automatically brought into service. Adjustments to the triggering of the print cycle are made to account for the different print heads at different locations.

8 Claims, 2 Drawing Sheets

METHOD AND APPARATUS FOR CONTINUOUS HIGH SPEED DIGITAL METERING USING MULTIPLE PRINT HEADS

TECHNICAL FIELD

The present invention relates to a module for printing postage value, or other information, on an envelope in a high speed mail processing and inserting system. Within the postage printing module, a digital print mechanism is used at high speeds to create the postal indicia for the envelopes.

BACKGROUND OF THE INVENTION

Inserter systems such as those applicable for use with the present invention, are typically used by organizations such as banks, insurance companies and utility companies for producing a large volume of specific mailings where the contents of each mail item are directed to a particular addressee. Also, other organizations, such as direct mailers, use inserts for producing a large volume of generic mailings where the contents of each mail item are substantially identical for each addressee. Examples of such inserter systems are the 8 series, 9 series, and APS™ inserter systems available from Pitney Bowes Inc. of Stamford Conn.

In many respects, the typical inserter system resembles a manufacturing assembly line. Sheets and other raw materials (other sheets, enclosures, and envelopes) enter the inserter system as inputs. Then, a plurality of different modules or workstations in the inserter system work cooperatively to process the sheets until a finished mail piece is produced. The exact configuration of each inserter system depends upon the needs of each particular customer or installation.

Typically, inserter systems prepare mail pieces by gathering collations of documents on a conveyor. The collations are then transported on the conveyor to an insertion station where they are automatically stuffed into envelopes. After being stuffed with the collations, the envelopes are removed from the insertion station for further processing. Such further processing may include automated closing and sealing the envelope flap, weighing the envelope, applying postage to the envelope, and finally sorting and stacking the envelopes.

Current mail processing machines are often required to process up to 18,000 pieces of mail an hour. Such a high processing speed may require envelopes in an output subsystem to have a velocity in a range of 80–85 inches per second (ips) for processing. Consecutive envelopes will nominally be separated by a 200 ms time interval for proper processing while traveling through the inserter output subsystem. Meters must print a clear postal indicia on the appropriate part of the envelope to meet postal regulations. The meter must also have the time necessary to perform the necessary bookkeeping and calculations to ensure the appropriate funds are being stored and printed.

A typical postage meter used with a conventional high speed mail processing system has a mechanical print head that imprints postage indicia on envelopes being processed. Such conventional postage metering technology is available on Pitney Bowes R150 and R156 mailing machines using model 6500 meters. The mechanical print head is typically comprised of a rotary drum that impresses an ink image on envelopes traveling underneath. Using mechanical print head technology, throughput speed for meters is limited by considerations such as the meter's ability to calculate postage and update postage meter registers, and the speed at which ink can be applied to the envelopes. In most cases, solutions using mechanical print head technology have been found adequate for providing the desired throughput of approximately five envelopes per second.

However, use of existing mechanical print technology with high speed mail processing machines presents some challenges. First, some older mailing machines were not designed to operate at such high speeds for prolonged periods of time. Accordingly, alternate solutions may be desirable in terms of enhancing long term mailing machine reliability.

Another problem is that many existing mechanical print head machines are configured such that once an envelope is in the mailing machine, it is committed to be printed and translated to a downstream module, regardless of downstream conditions. As a result, if there is a paper jam downstream, the existing mailing machine component could cause even more collateral damage to envelopes within the mailing machine. At such high rates, jams and resultant damage may be more severe than at lower speeds.

Controlling throughput through the metering portion of a mail production' system is also a significant concern when using non-mechanical print heads. Many current mailing machines use digital printing technology to print postal indicia on envelopes. One form of digital printing that is commonly used for postage metering is thermal ink jet technology. Thermal ink jet technology has been found to be capable of generating images at 300 dpi on material translating up to 50 inches per second (ips) and 200 dpi at 80 ips.

As postage meters using digital print technology become more prevalent in the marketplace, it is important to find suitable substitutes for the mechanical print technology meters that have traditionally been used in high speed mail production systems. This need for substitution is particularly important as it is expected that postal regulations will require phasing out of older mechanical print technology meters, and replacement with more sophisticated meters. Ink jet digital print technology is now capable of printing a desired 200 dpi resolution on paper traveling at 80 ips., but has not yet been incorporated in the metering portions of high speed mail production systems.

It is known that many standard ink jet print heads must be stopped occasionally in order to perform maintenance routines. In particular, "drop-on-demand" style ink jet print heads are known to require periodic maintenance. Maintenance may include a "print head wipe" that occurs approximately every 500 prints, and has a duration of approximately 3 seconds. Maintenance also may include a "print head purge" that occurs after approximately every 3000 prints, and has a duration of approximately 14 seconds. For an inserter operating at 18,000 pieces per hour, the wipe and purge activities would occur every 100 seconds and ten minutes respectively. These maintenance activities would result in reduced throughput performance. For example, an inserter that would otherwise operate at 18,000 piece per hour, would be reduced to 17,000 pieces per hour as a result of purge and wipe print head maintenance.

More expensive ink jet technology is available that does not require such frequent maintenance. For example, Scitex™ ink jet printers can run continuously, with no significant interruption. However, such continuous printers can be prohibitively expensive, and it is preferred that less expensive drop-an-demand ink jet print head technology can be used.

Some systems that have been available from Pitney Bowes for a number of years have used slower speed mechanical meters with a higher speed mail production system. These systems utilize mechanical print head R150 and R156 mailing machines using 6500 model postage meters installed on an inserter system. The postage meters operate at a slower velocity than that of upstream and downstream modules in the system. When an envelope reaches the postage meter module, a routine is initiated within the postage meter. Once the envelope is committed within the postage meter unit, this routine is carried out without regard to conditions outside the postage meter. The routine decelerates the envelope to a printing velocity. Then, the mechanical print head of the postage meters imprints an indicia on the envelope. After the indicia is printed, the envelope is accelerated back to close to the system velocity, and the envelope is transported out of the meter.

Using the R150 or R156 mailing machines in this manner postage can be printed on envelopes at a lower print velocity. However, problems still occur for systems operating at higher velocities, such as 80 ips. At this higher speed, the time interval between consecutive envelopes is so short that the R150 and R156 machines cannot reset itself in time to print an indicia on a second envelope. To solve this problem, Pitney Bowes has offered a solution for number of years utilizing two mailing machines arranged serially in the envelope transport path. A diagram of this prior art system is depicted in FIG. 1.

In this serial mailing machine solution, envelopes are transported along transport path 100. When a first of a series envelopes reaches the first serial mechanical mailing machine 101, the first envelope is decelerated for a printing operation by postage meter 104. After printing is complete, the first envelope is carried away from the first serial machine 101 via transport 102 to the second serial mechanical mailing machine 103.

At the second mailing machine 103, the first envelope is typically decelerated to the print velocity. However, since an indicia has already been printed on the first envelope, no printing operation is performed by the second postage meter 105. The first envelope is then accelerated back to the system velocity and carried out of the serial postage printing arrangement.

The motion control of deceleration and acceleration at the second postage meter 105 without performing a print operation is done in order to maintain the displacements of consecutive envelopes in the system. Failure to subject subsequent envelopes to the same displacements may result in one envelope catching up to the other and causing a jam.

Following the first envelope, a second envelope arrives at the first mailing machine 101. The second envelope is subjected to the deceleration and acceleration motion profile. In a high speed system, however, the first postage meter 104 may not have had time to reset to print another indicia. Accordingly, the second envelope passes through the first mailing machine 101 without a printing operation. The second envelope is then passed via transport 102 to the second mailing machine 103 where it is again decelerated to the print velocity. This time, mailing machine 103 does perform a printing operation and an indicia is printed on the second envelope by postage meter 105. Mailing machine 103 then accelerates the envelope back to the system velocity, and the second envelope is carried away downstream.

In this manner, some of the shortcomings of conventional mailing machines are avoided by allowing the serial mailing machines 101 and 103 to alternately take turns printing indicia on every-other envelope. One disadvantage of this prior art serial arrangement is that it remains very sensitive to gaps sizes between consecutive envelopes.

Another problem with existing solution is that the conventional postage meters are inflexible in adjusting to conditions present in upstream or downstream meters. For example, if the downstream module is halted as a result of a jam, the postage meter will continue to operate on whatever envelope is within its control. This often results in an additional jam, and collateral damage, as the postage meter attempts to output the envelope to a stopped downstream module.

SUMMARY OF THE INVENTION

The present application describes a printing apparatus and method to for use in a continuous high velocity document processing system. In the preferred embodiment, they printing system is used in connection with a postage meter for imprinting postal indicia on mail pieces. The print apparatus is preferably located at the downstream end of an inserter device for mass producing mail pieces.

Within the printing system, a transport path conveys a series of mail pieces at a print velocity. In the preferred embodiment, there are at least two print heads to perform printing operations. The print heads are preferably available ink jet print heads capable of printing at high resolution on documents traveling at high speed. During normal operation, only one print head is operating at a time. As mail pieces pass the print head at the print velocity, postal indicia are printed on them.

However, continuous operation of the printing apparatus is potentially interrupted when the print head that is in use must stop in order to undergo a maintenance operation. Accordingly, in accordance with the present invention, the second print head goes into operation without interruption of the document processing flow.

In the preferred embodiment, the print heads are in series. Thus, when one print head is taken out of service, the other one continues to print on documents in the same transport path. Because the second print head may be at a different location along the transport path, appropriate adjustments to the triggering of the print cycle are required.

In an alternate embodiment, a parallel print head arrangement may be used. Under this alternate embodiment, a flipper switch redirects documents to a parallel transport path and a parallel print head, when the first one is out of service. In either embodiment, the activation of a second print head may also be triggered when the first print head is subject to a failure that prevents it from being used. Thus, it may not be necessary to halt operation of the mail production process.

Further details of the present invention are provided in the accompanying drawings, detailed description and claims.

DETAILED DESCRIPTION

For the preferred embodiment of the present invention, it is desired that envelope printing throughput of 18,000 mail pieces per hour be achieved. To support this throughput, the preferred ink jet printing device to be used for printing a postage indicia is capable of achieving a desired resolution of 200 dpi at a speed of 80 ips. Such print heads are known to be available from printer manufacturers Canon, Brother and Hewlett-Packard.

Figure 1:
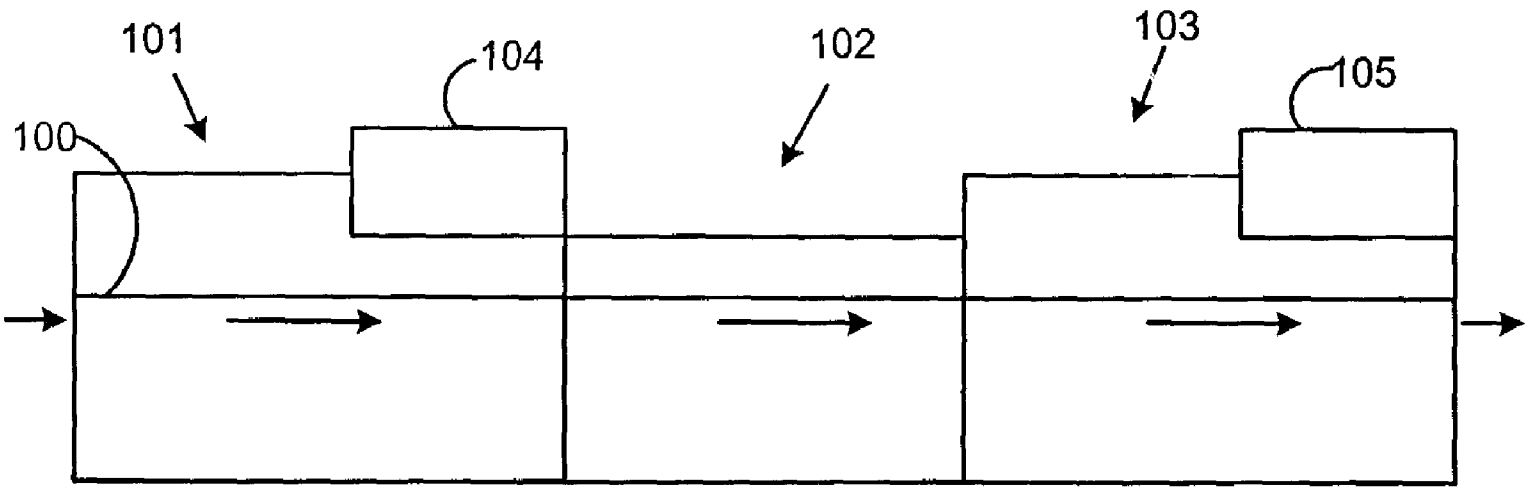
FIG. 1 ( PRIOR ART)
FIG. 1 depicts a prior art inserter metering system using two mechanical meters in series.
Figure 2:
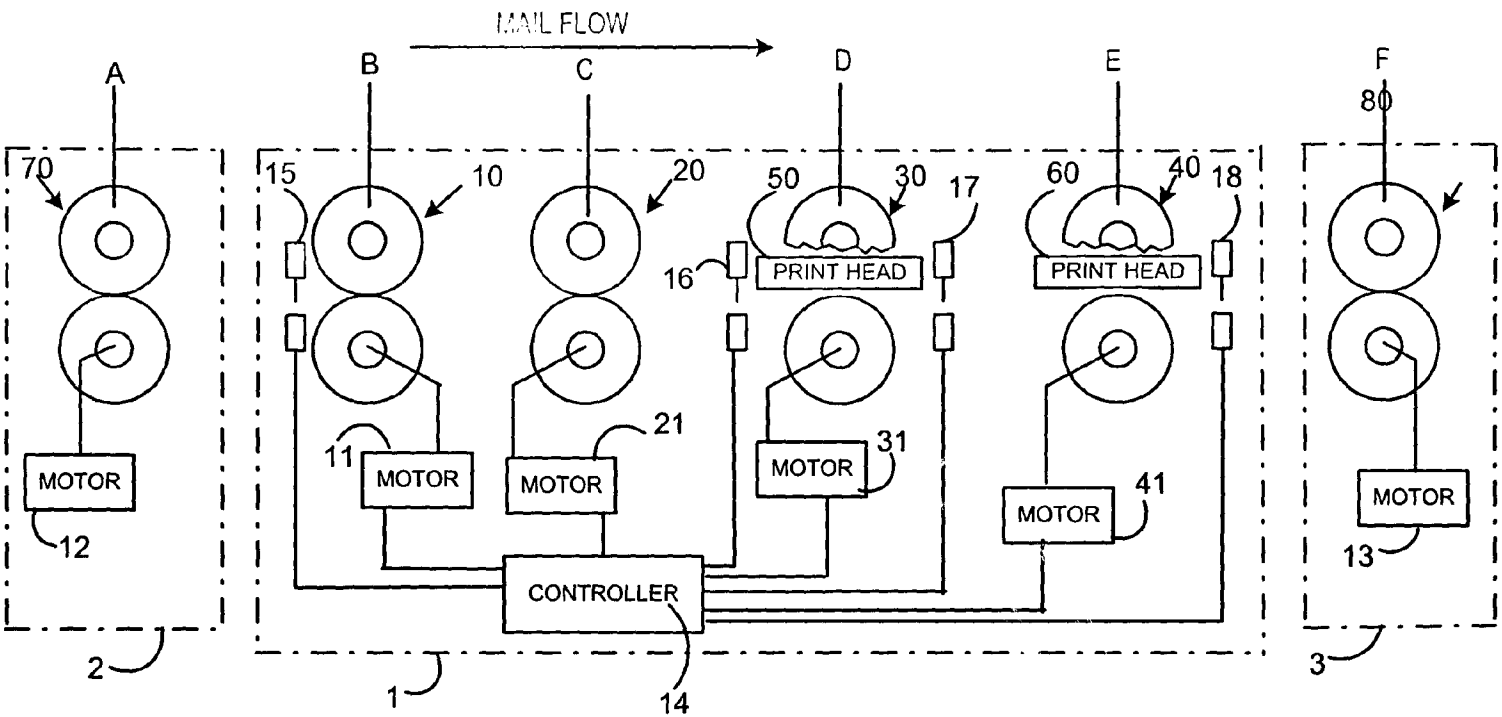
FIG. 2 is a diagrammatic view of a postage printing module in relation to upstream and downstream modules.

As seen in FIG. 2, the present invention includes a postage printing module 1 positioned between an upstream module 2 and a downstream module 3. Upstream and downstream modules 2 and 3 can be any kinds of modules in an inserter output subsystem. Typically the upstream module 2 could include a device for wetting and sealing an envelope flap. Downstream module 3 could be a module for sorting envelopes into appropriate output bins.

Postage printing module 1, upstream module 2, and downstream module 3, all include transport mechanisms for moving envelopes along the processing flow path. In the depicted embodiment, the modules use sets of upper and lower rollers 10, 20, 30, 40, 70, and 80 called nips, between which envelopes are driven in the flow direction. In the preferred embodiment rollers 10, 20, 30, 40, 70, and 80 are hard-nip rollers to minimize dither. The transport for module 1 may also be belts, or other known transport mechanisms.

Print heads 50 and 60 are preferably located at or near the output end of the print transport portion of the postage printing module 1 (see locations D and E). To satisfy desired readability the print heads 50 and 60 use drop-on-demand ink jet technology capable of printing an indicia at a resolution of 200 dots per inch (dpi) on media traveling at 80 ips.

In the preferred embodiment only one of print heads 50 or 60 is in use at a given time. Typically, one of the print heads, for example 50, will be used to print indicia on the stream of envelopes. Using the present invention, when it is time for print head 50 to undergo a maintenance cycle, rather than pause or delay printing of indicia, print head 60 is brought into service to do the same job. Thus, one print head operates at a time, with the other held in reserve. The reserve print head goes into service when the primary undergoes a maintenance routine, or otherwise becomes unavailable. The reserve may then continue operation as the primary print head, and the former primary may become the reserve when the maintenance operation is complete. Alternately, the primary may be brought back into service when maintenance is complete, and the reserve returned to inactive status.

The rollers 10, 20, 30, and 40 for postage printing module 1 are driven by motors 11, 21, 31, and 41. For modules 2 and 3, rollers 70 and 80 are driven by electric motors 12 and 13 respectively. Motors 11, 21, 31, 41, 12, and 13 are preferably independently controllable servo motors. Motors 12 and 13 in upstream and downstream modules 2 and 3 drive rollers 70 and 80 at a constant velocity, preferably at the desired nominal velocity for envelopes traveling in the system. Thus in the preferred embodiment, upstream and downstream modules 2 and 3 will transport envelopes at 80 ips in the flow direction. Instead of independently controllable motors, the transports for module 1 may be driven in any known manner. For example, the rollers 10, 20, 30, and 40 could be all geared to a single driving mechanism. However, the arrangement of separate control is preferred because it allows for more flexibility in controlling motion within the print module 1.

Postage printing module motors 11, 21, 31, and 41 are controlled by controller 14 which in turn receives sensor signals. Signals may be provided to the controller 14 from upstream sensor 15, downstream sensor 18, and trigger sensors 16 and 17. Sensors 15 and 18 are preferably used to detect the trailing edges of consecutive envelopes passing through the postage printing module 1. Trigger sensor 16 determines that an envelope to be printed with an indicia is in the appropriate position to trigger the beginning of the printing sequence for print head 60.

Sensors 15, 16, 17 and 18 are preferably photo sensors that are capable of detecting leading and trailing edges of envelopes. While four photo sensors are depicted in the embodiment of FIG. 2, the system can be operated with as few as one photo sensor at an upstream location. The upstream single photo sensor would generate a signal upon detecting the presence of a lead or trail edge of an envelope. Subsequent to sensing the envelope, encoder pulses from the servo motors (11, 21, 31, 41) transporting the envelope could be counted, and the corresponding displacement can be accurately determined. Thus the controller 14 could trigger an action based on the sensing of an envelope edge, and then counting a predetermined quantity of pulses from the motor encoders. The preferred positioning of the sensors, and the utilization of signals received from the sensors are discussed in more detail below.

Referring to FIG. 2, the location of the output of the transport for upstream module 2 is location A. The location for the input to the print transport of postage printing module 1 is location B. An intermediary transport roller 20 is located at point C. Transports 30 and 40 for print heads 50 and 60 are located at points D and E. Point E is also the output of the print transport mechanism for postage printing module 1. The input for the transport of downstream module 3 is location F.

The modules may also include other rollers, or other types of transports, at other locations. To maintain control over envelopes traveling through the system, consecutive distances between rollers 10, 20, 30, and 40 must be less than the shortest length envelope expected to be conveyed. In the preferred embodiment, it is expected that envelopes with a minimum length of 6.5" will be conveyed. Accordingly and the rollers 10, 20, 30, and 40 will preferably be spaced not more than 6.25" apart, so that an envelope can be handed off between sets of rollers without giving up control transporting the envelope at any time. The preferred embodiment is also designed to handle an envelope 10.375 inches long.

Upstream sensor 15 is preferably located at or near location B, while downstream sensor 16 is preferably located at or near location E. Trigger sensors 17 and 18 are preferably located upstream from print heads 50 and 60 by a sufficient distance to permit triggering of a print cycle in the active print head. The trigger sensors 17 and 18 may be located any distance upstream from the minimum deceleration point, even as far upstream as upstream sensor 15, so long as the print trigger control determined by controller 14 is adjusted accordingly.

In the preferred embodiment depicted in FIG. 2, the following distances between components has been found to most effectively handle the expected range of envelope sizes:

A to B, 3.7 inches;
B to C, 3.9 inches;
C to D, 3.9 inches;
D to E, 6.25 inches; and
E to F, 6.1 inches.

The print heads 50 and 60 are preferably located just downstream of nip roller sets 30 and 40. This location allows greater control at the print head location, and also minimizes the opportunity for errors relating to an envelope tail kick. Tail kick occurs when the trail edge of an envelope is not adequately constrained and comes into contact with a print head, thereby causing print head damage and failure.

The preferred embodiment depicted in FIG. 2, depicts an exemplary serial arrangement of two print heads, whereby one may be taken out of service while the other undergoes a maintenance cycle. An alternative embodiment could utilize a parallel arrangement. Under this parallel arrangement, a flipper gate would be activated when the active print head is taken out of service. The flipper gate would redirect envelopes to a second parallel transport where the back-up print head prints indicia on envelopes. An exemplary parallel path system that would be suitable for use in this manner is depicted in co-pending U.S. patent application Ser. No. 10/226,744, entitled PARALLEL PROCESSING HIGH SPEED PRINTING SYSTEM FOR AN INSERTING SYSTEM, by John Sussmeier, filed Aug. 22, 2002 , hereby incorporated by reference.

In a further preferred embodiment of the present invention, to ensure accurate printing, the rate at which the print heads 50 and 60 print the indicia can be electronically or mechanically geared to the speed of the print transport in the print module 1. In such case, under circumstances where the print transport is operating outside of nominal conditions, a correct size and resolution print image can be generated. In the electronic version of this preferred embodiment, controller 14, print head 50 or 60, and the master roller servomotor 31 or 41 are geared to the same velocity and timing signals to provide that the transport and printing are always in synchronism.

Displacement information for respective print, upstream, and downstream modules 1, 2, and 3 may typically be monitored via encoders in motors 11, 21, 31, and 41. The encoders register the mechanical movement of the module transports and report the displacements to controller 14 for appropriate use by controller 14 to maintain correct displacement mapping between the modules.

In the preferred embodiment discussed in this application, the transport velocity throughout the mail production system is matched to the maximum attainable velocity of the print heads 50 and 60. It may be desirable to increase system throughput by increasing the transport velocity in the mail production system. Since print heads 50 and 60 may be incapable of achieving the desired resolution at such higher transport velocities, it may be necessary to introduce a motion control mechanism whereby envelopes are decelerated to the lower print velocity when they enter the print module 1. Printing would then be performed at the lower print velocity before being returned to higher transport velocity when passed downstream. Within the print module 1 the motion control would need to account for which of the two print heads was in use during the print motion control profile. A preferred embodiment for the print module 1 transport mechanism and control is described in co-pending U.S. patent application Ser. No. 10/675,403, titled METHOD AND SYSTEM FOR HIGH SPEED DIGITAL METERING, by John Sussmeier, Richard Stengl, and Jerry Leitz, filed on the same date at this application.

In this application, a preferred embodiment of the system has been described in which documents being processed are envelopes. It should be understood that the present invention may be applicable for any kind of document on which printing is desired. Also a package or a parcel to which a printed image is applied as part of a processing system should also be considered to fall within the scope of the term "document" as used in this application.

The preferred embodiment was also described herein as including two print heads. It will be understood by one of ordinary skill in the art that the invention may utilize more than two print heads, and that nothing in this description is intended to limit the invention from using more than two.

Although the invention has been described with respect to a preferred embodiment thereof, it will be understood by those skilled in the art that the foregoing and various other changes, omissions and deviations in the form and detail thereof may be made without departing from the spirit and scope of this invention.

What is claimed is:

1. A postage meter printing apparatus for use in a continuous high velocity mail piece processing system, the printing apparatus comprising:

a transport path conveying a series of mail pieces at a print velocity;

an upstream ink jet print head fixedly positioned contiguous with the transport to print postage indicia on mail pieces transported thereon;

a downstream ink jet print head, fixedly positioned downstream of the upstream print head, and contiguous with the transport to print postage indicia on mail pieces transported thereon;

a controller controlling a first one of the upstream or downstream print heads to print postage indicia on transported mail pieces traveling at a print velocity, the controller further switching to a second of the upstream or downstream print heads when the first one undergoes a periodic ink jet maintenance operation; at predetermined intervals wherein the controller periodically takes the print head that is in use out of service to perform maintenance operations; whereby the maintenance operations are a print head wipe or a print head purge and whereby subsequent to a maintenance operation the first print head is in a condition to return to service.

2. The printing apparatus of claim 1 wherein the upstream and downstream print heads are comprised of drop-on-demand print heads.

3. The printing apparatus of claim 1 further comprising at least one sensor upstream of the first or second print head detecting a mail piece approaching the upstream or downstream print head, the controller triggering the upstream or downstream print head based on a predetermined interval subsequent to detecting the mail piece, the controller adjusting the predetermined interval depending on which of the upstream or downstream print head is in use to account for the different locations of the upstream and downstream print heads.

4. The printing system of claim 1 wherein the print heads are electronically geared to the transport so that variations in print velocity during a printing operation will not affect an image being printed.

5. A printing method for continuous high velocity mail piece processing, the printing method comprising:

transporting a series of mail pieces at a print velocity;

fixedly positioning an upstream ink jet print head contiguous with a transport to print on mail pieces transported thereon at the print velocity;

fixedly positioning a downstream ink jet print head, downstream of the upstream print head, and contiguous with the transport to print on mail pieces transported thereon at the print velocity;

controlling a first one of the upstream or downstream print heads to print postage indicia on transported mail pieces traveling at the print velocity;

periodically removing the print head that is in use out of service and performing maintenance operations on the print head, at predetermined intervals the maintenance operations comprising a print head wipe or a print head purge;

switching to a second of the upstream or downstream print heads for printing when the first one is removed for maintenance operations; and returning the print head removed from service back into service after performing the maintenance operations.

6. The printing method of claim 5 further comprising using drop-on-demand ink jet printing for the upstream and downstream print heads.

7. The printing method of claim 5 further comprising detecting a mail piece approaching the upstream or downstream print head, triggering the upstream or downstream print head based on a predetermined interval subsequent to detecting the mail piece, and adjusting the predetermined interval depending on which of the upstream or downstream print head is in use to account for the different locations of the upstream and downstream print heads.

8. The printing method of claim 5 further including electronically gearing the print heads to the transport so that variations in print velocity during printing will not affect an image being printed.

* * * * *